US005951355A

United States Patent [19]

Dana et al.

[11] Patent Number: 5,951,355

[45] **Date of Patent: *Sep. 14, 1999**

[54] COMBINED BOOK AND TOY OBJECT AND METHOD THEREFOR

[75] Inventors: Bill Dana, Hana, Hi.; Mark Hannah, Scottsdale, Ariz.

[73] Assignee: Bill Dana Enterprises, Inc., Hana, Hi.

[ * ] Notice: This patent issued on a continued prosecution application filed under 37 CFR 1.53(d), and is subject to the twenty year patent term provisions of 35 U.S.C. 154(a)(2).

[21] Appl. No.: 08/714,689

[22] Filed: Sep. 16, 1996

Related U.S. Application Data

[63] Continuation-in-part of application No. 08/675,245, Jul. 2, 1996, abandoned.

[51] Int. Cl.[6] ..... A63H 3/00

[52] U.S. Cl. ..... 446/73; 446/75; 446/147

[58] Field of Search ..... 446/147, 72, 73, 446/71, 75, 76, 478, 476; 19/26, 28, 29, 30, 31

[56] References Cited

U.S. PATENT DOCUMENTS

| | | | |
|---|---|---|---|
| 4,874,340 | 10/1989 | Smallwood | 446/72 X |
| 5,090,938 | 2/1992 | Reynolds | 446/73 X |
| 5,472,364 | 12/1995 | Castleman | 446/147 X |

*Primary Examiner*—Robert A. Hafer
*Assistant Examiner*—Laura Fossum
*Attorney, Agent, or Firm*—Harry M. Weiss; Jeff Weiss; Paul W. Davis

[57] ABSTRACT

A combined dual object device and method is disclosed which can be configured either to display a book or an animate type object. In another embodiment of the present invention, a dual object device and method is disclosed which is in the form of a book which stores a child's blanket. The combined dual object device and method preferably have a pocket on a surface thereof for securing an audiotape or a compact disk.

8 Claims, 3 Drawing Sheets

COMBINED BOOK AND TOY OBJECT AND METHOD THEREFOR

RELATED APPLICATION

This is a Continuation in Part of U.S. Ser. No. 08/675,245, filed Jul. 2, 1996, in the name of Mark Hannah, one of the applicant's of this application, now abandoned.

BACKGROUND OF THE INVENTION

1. Field of Invention

This invention relates generally to soft, decorative material devices and methods and, more specifically, to a combined book and toy object and method therefore. In one embodiment, the this invention relates to a soft, decorative material device having a first exterior configuration resembling a book and having a second exterior configuration resembling an animate type of object after reversing the device through a VELCRO seal. In another embodiment, this invention relates to a book and toy object and method wherein a soft material object having an exterior configuration of a book is provided, which book has located therein a storage space for receiving a blanket. The book and toy object and method of this invention preferably has securing means on a surface thereof for securing an audiotape or a compact disk.

2. Background of the Invention

In a pending United States Patent Application in the name of Applicant Mark Hannah, this Applicant claims a dual object device and method, wherein a first exterior configuration resembles an inanimate type of object such as a sports projectile, and having a second exterior configuration resembling an animate type of object such as a bear after reversing the device through a VELCRO seal.

The device that is the subject of Applicants' pending application is typically marketed to children. However, it essentially consist of two "play" type toys—an inanimate object such as a sports projectile and an animate object such as a stuffed animal. Ideally, during the childraising process, parents will try to acclimate their children to books. For younger children, this can mean soft and even bathtub-safe books haviug only limited written material. As children grow older, the books they are exposed to will begin to look more and more like the books that their parents read.

However, it can be difficult to interest young children in books. Parents often find that their children show little or no desire to look at or play with even soft, child-friendly books. Instead, children often prefer to play with their non-book toys. Moreover, many young children have what are referred to as transitional objects—typically soft objects such as blankets or stuffed animals that a child likes to hold onto for comfort when sleeping or when in unfamiliar surroundings. Books are rarely made into transitional objects.

Thus, a need existed for a soft, combination book and toy object, that will introduce a young child to books in a soft and friendly manner. In order to be attractive to a child who is only beginning to be exposed to books, the combination book and toy object should be able to be converted into a stuffed animal or should be able to accommodate a child's blanket—two classic transitional objects. In this fashion, the book can become a part of a child's daily routine, an important step on the road to teaching a child the importance of books and reading. Ideally, the combination book and toy object should also have a pocket for holding an audiotape or compact disk, to help the child learn to integrate different media—e.g., to connect the song "Mary Had a Little Lamb" with a stuffed animal in the form of a lamb.

SUMMARY OF THE INVENTION

It is an object of the present invention to provide an improved combined book and toy object and method.

It is another object of this invention to provide an improved combined book and toy object and method having one exterior configuration resembling a book and another exterior configuration resembling an animate type object.

It is still another object of this invention to provide an improved combined book and toy object and method having one exterior configuration resembling a book and another exterior configuration resembling an animate type object and having means for securing therein an audiotape or compact disk.

It is a further object of this invention to provide an improved combined book and toy object and method having an exterior configuration resembling a book and having a storage space therein for receiving and storing a child's blanket.

It is still a further object of this invention to provide an improved combined book and toy object and method having an exterior configuration resembling a book and having a storage space therein for receiving and storing a child's blanket and having means for securing therein an audiotape or compact disk.

BRIEF DESCRIPTION OF THE PREFERRED EMBODIMENTS

In accordance with one embodiment of this invention, a combined dual object device is disclosed. The combined dual object device comprises, in combination: a soft material object having a first exterior configuration of a book and a second exterior configuration of an animate type object; hook and loop fastening means comprising a pair of hook and loop fastening members for opening and closing a surface portion of the book; and an interior portion of the book having the second exterior configuration of an animate type object when the interior portion of the book is exposed to become the second animate type exterior configuration by reversing through the hook and loop fastening means the interior portion of the book.

In accordance with another embodiment of the present invention, a combined dual object device is disclosed. The combined dual object device comprises, in combination: a soft material object having an exterior configuration of a book; a blanket; storing means located within an interior portion of the book for containing the blanket; and fastening means coupled to the book for opening and closing an exterior portion of the book to permit access to the blanket and removal thereof from within the interior portion of the book.

In accordance with still another embodiment of the present invention, a method of providing a combined dual object device is disclosed. The method comprises the steps of: providing a soft material object having a first exterior configuration of a book and a second exterior configuration of an animate type object; providing hook and loop fastening means comprising a pair of hook and loop fastening members for opening and closing a surface portion of said book; and providing an interior portion of said book having said second exterior configuration of an animate type object when said interior portion of said book is exposed to become said second animate type exterior configuration by reversing through said hook and loop fastening means the interior portion of said book.

In accordance with yet another embodiment of the present invention, a method of providing a combined dual object device is disclosed. The method comprises the steps of: providing a soft material object having an exterior configuration of a book; providing a blanket; providing storing means located within an interior portion of said book for containing said blanket; and providing fastening means coupled to said book for opening and closing an exterior portion of said book to permit access to said blanket and removal thereof from within said interior portion of said book.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
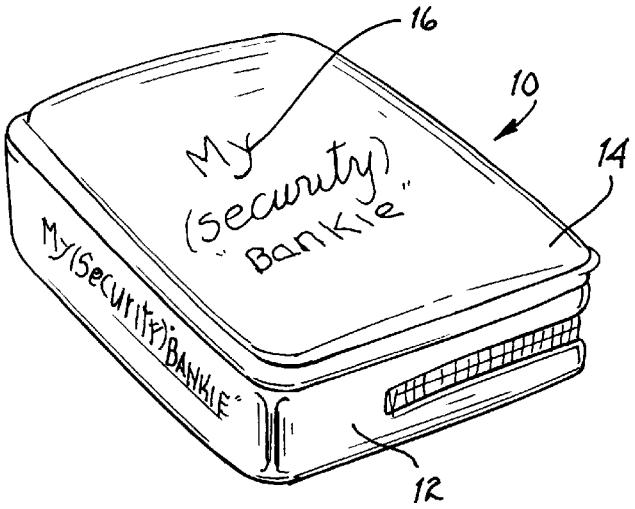
FIG. 1 is a perspective view of one embodiment of the combination book and toy object of the present invention showing a closed book.
Figure 2:
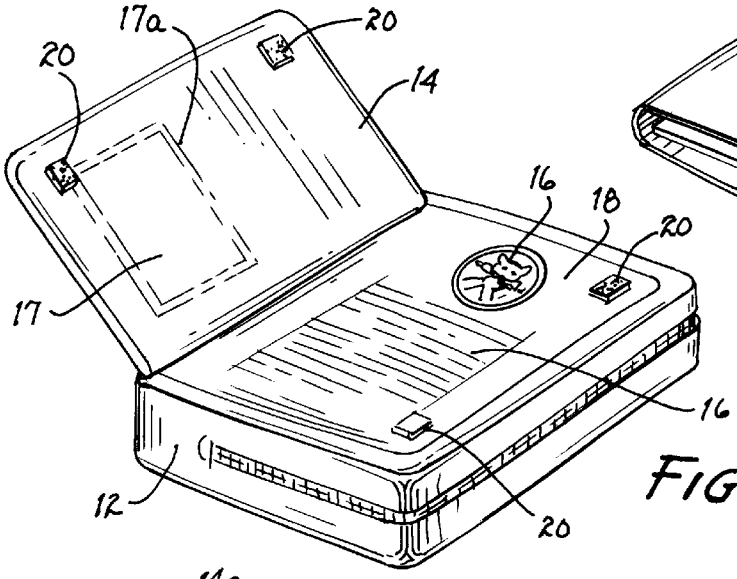
FIG. 2 is a perspective view of the combination book and toy object of FIG. 1 showing the cover of the book open and revealing printed matter on the inside of the book as well as a pocket for securing an audiotape or compact disk.
Figure 4:
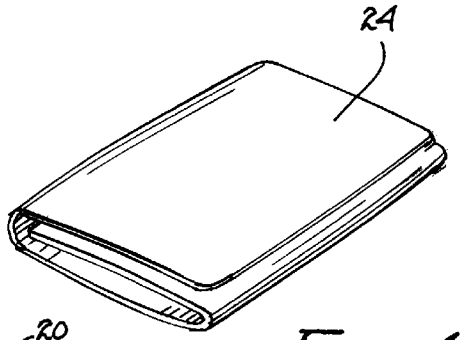
FIG. 4 is a perspective view of a folded-blanket, which is configured to be stored in the storage compartment shown in FIG. 3.
Figure 3:
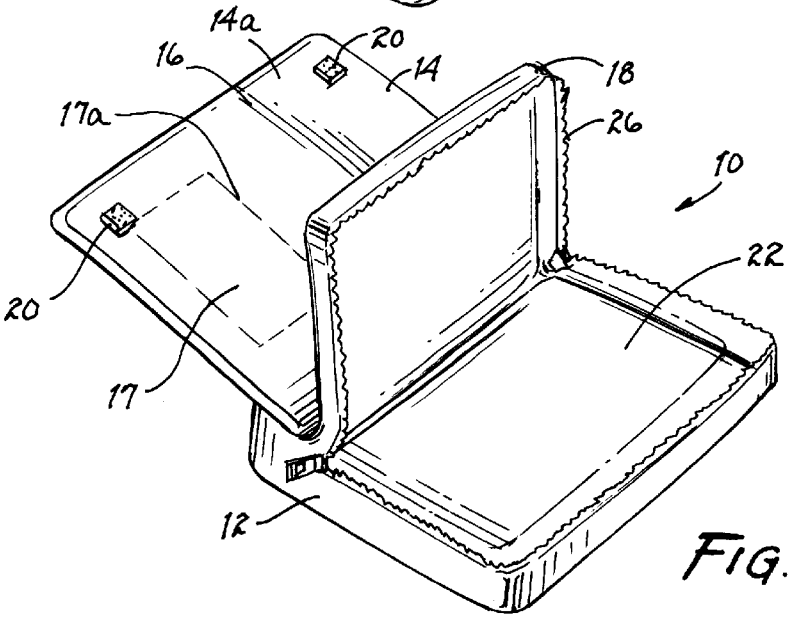
FIG. 3 is a perspective view of the combination book and toy object of FIG. 1 showing the cover and the storage compartment of the book in the opened position.

Referring to FIGS. 1–4, one embodiment of tlqe combined dual object device is shown and is generally designated by reference number 10. The external configuration of the device 10 resembles a book 12. As best shown in FIGS. 2 and 3, the book 12 has a cover 14 which may be opened by a child and which, upon opening, reveals an interior portion 14*a* of the cover 14. Located on the interior portion 14*a* is a preferably four-sided pocket 17, which pocket 17 is open at a top portion a thereof so that the pocket 17 may hold audiotapes, compact disks, or similar items. When opened, the cover 14 reveals the text page 18 of the book 12. The text page 18 may be decorated with images and/or words 16. The interior portion 14*a* may be releasably attached to the text page 18 with a plurality of hook and loop fastening means 20, located in corresponding portions of the interior portion 14*a* and the text page 18. The text page 18 may be opened to reveal a storage area 22, which storage area 22 is sufficiently large to contain a blanket 24 (see FIG. 4). The storage area 22 may be closed with fastening means 26, which in the preferred embodiment is a zipper assembly.

Figure 5:
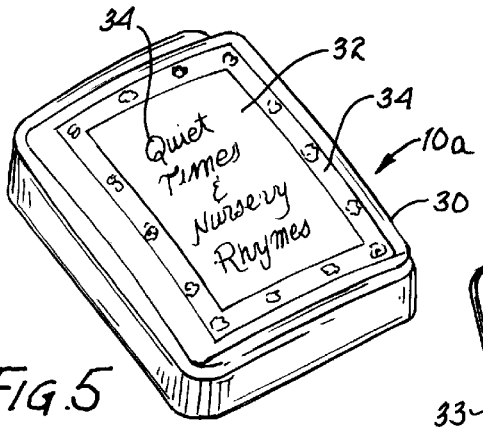
FIG. 5 is a perspective view of another embodiment of the combination book and toy object of the present invention showing a closed book.
Figure 6:
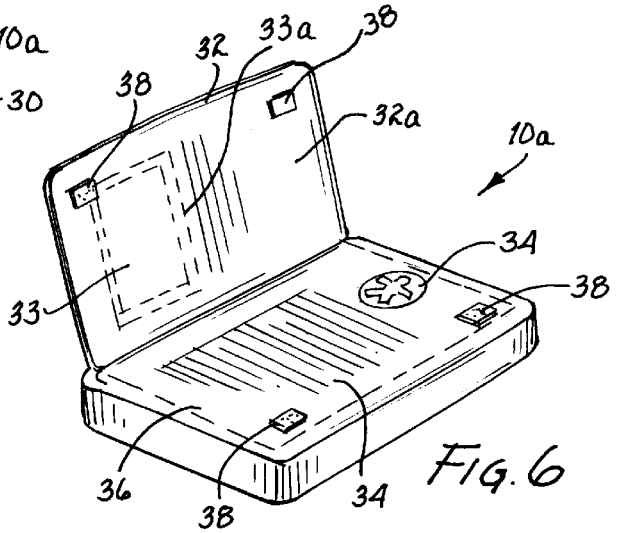
FIG. 6 is a perspective view of the combination book and toy object of FIG. 5 showing the cover of the book open and revealing printed matter on the inside of the book as well as a pocket for securing an audiotape or compact disk.
Figure 7:
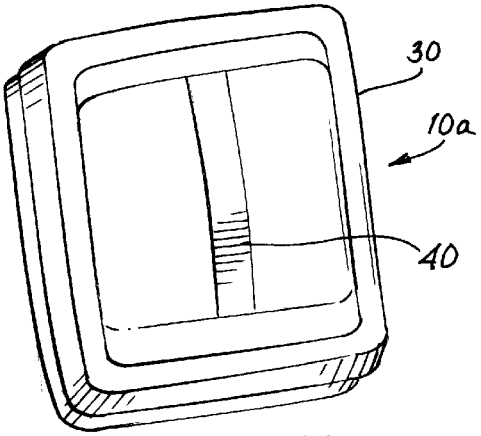
FIG. 7 is a rear perspective view of the combination book and toy object of FIG. 5.

Referring to FIGS. 5–12, another embodiment of the combined dual object device is shown and is generally designated by reference number 10*a*. As best shown in FIGS. 5–7, the external configuration of the device 10*a* resembles a book 30. The book 30 has a cover 32 which may be opened by a child and which, upon opening, reveals an interior portion 32*a* of the cover 32. Located on the interior portion 32*a* is a preferably four-sided pocket 33, which pocket 3 is open at a top portion 33*a* thereof so that the pocket 33 may hold audiotapes, compact disks, or similar items. The surface portion of the cover 32 may be decorated with images and/or words 34. When opened, the cover 32 reveals the text page 36 of the book 30. Like the cover 32, the text page 36 may be decorated with images and/or words 34. The interior portion 32*a* may be releasably attached to the text page 36 with a plurality of hook and loop fastening means 38, located in corresponding portions of the interior portion 32*a* and the text page 36.

Figure 8:
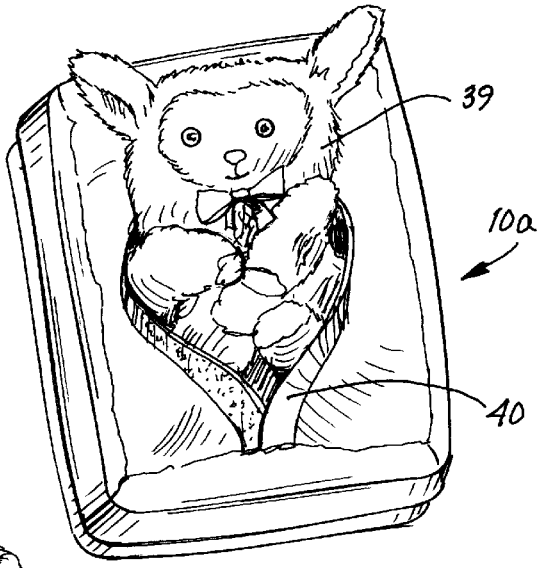
FIG. 8 is a rear perspective view of the combination book and toy object of FIG. 5, showing a lamb emerging from the book as one (animate) object of the combined book and toy object and showing a partially-opened VELCRO seal.
Figure 9:
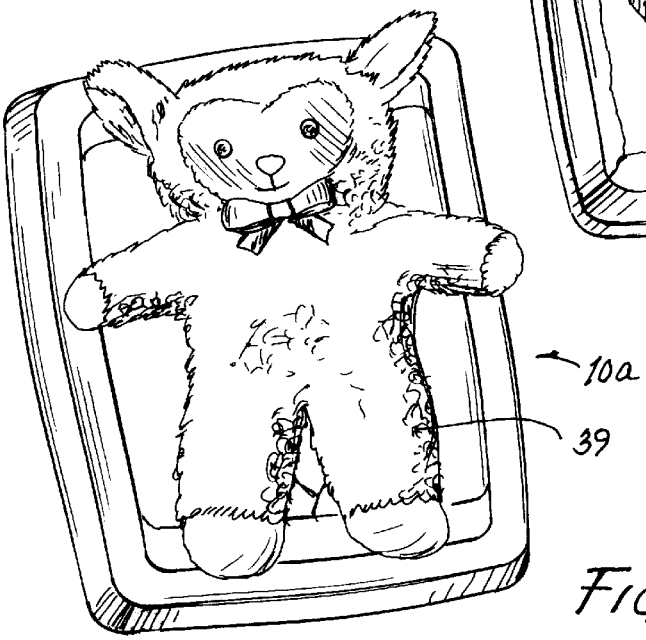
FIG. 9 is a rear perspective view of the combination book and toy object of FIG. 5, showing a lamb more fully emerging from the book as one (animate) object of the combined book and toy object.
Figure 10:
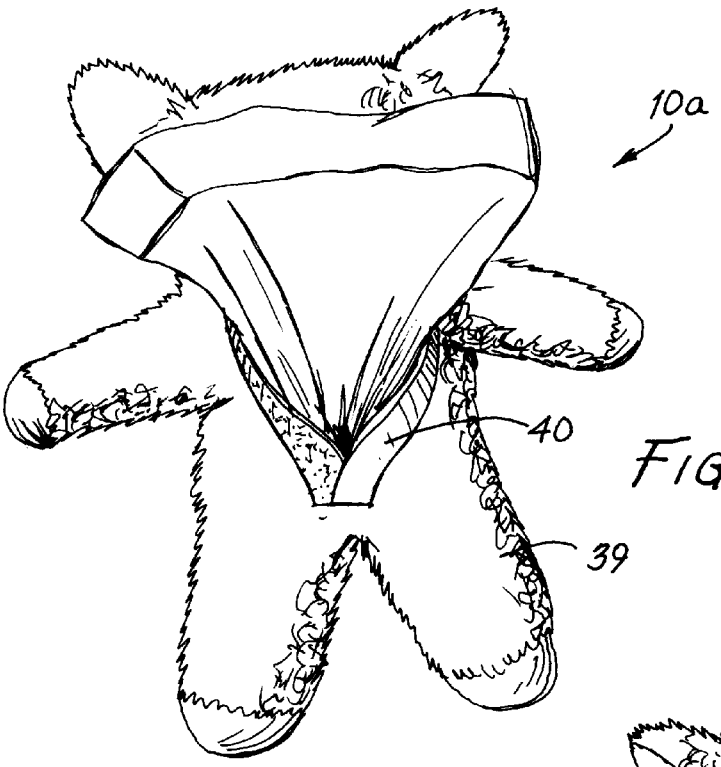
FIG. 10 is a rear perspective view of the lamb of FIG. 8 showing the insertion of the book into the back of the lamb through a partially opened VELCRO seal.
Figure 11:
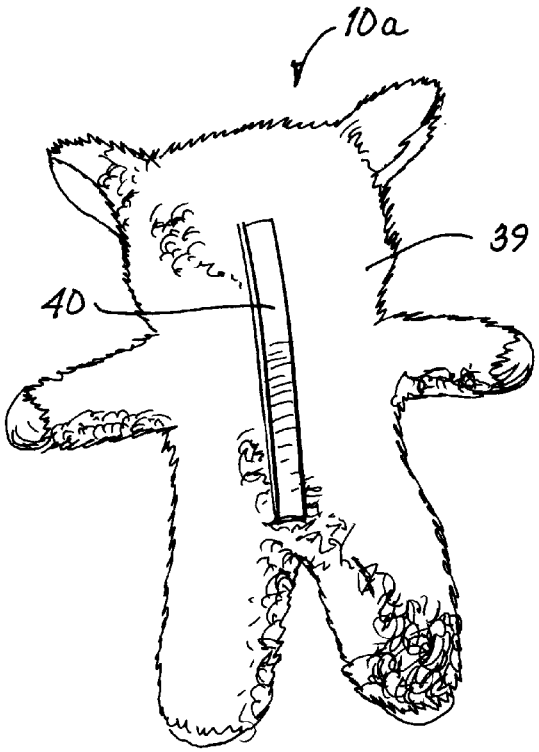
FIG. 11 is a rear perspective view of the lamb of FIG. 8 after the book has been completely inserted therein showing a closed VELCRO seal.
Figure 12:
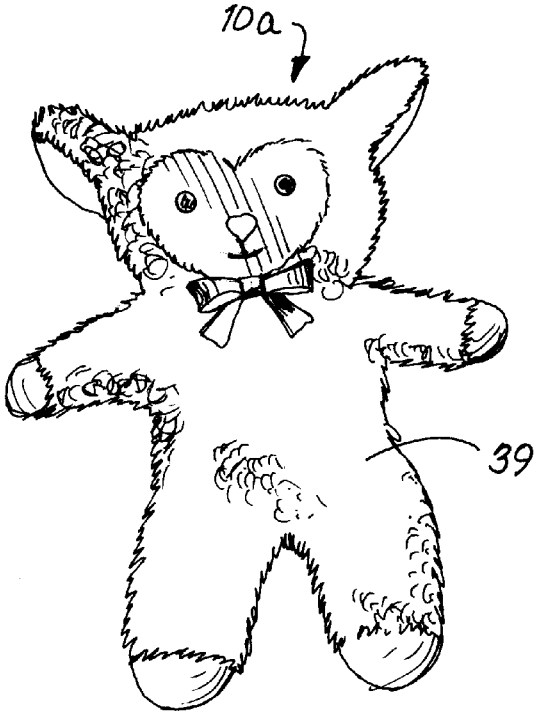
FIG. 12 is a perspective view of the lamb of FIG. 11.

As best shown in FIGS. 8–12, a second external configuration of the device 10*a* resembles an animate type object, and is shown to be a lamb 39. As best shown in FIGS. 8–10, hook and loop fastening means 40 are attached both to the lamb 39 and to the book 30, which allow the transformation from one configuration to another. The consecutive progression of FIGS. 8–12 shows the device 10*a* evolve from the book 30 to the lamb 39. In a similar manner, the process can be reversed to reveal the book 30. Referring specifically to FIG. 9, the animate type object is shown emerging from the rear portion of the book to coexist with the book.

While the invention has been particularly shown and described with reference to preferred embodiments thereof, it will be understood by those skilled in the art that the foregoing and other changes in form and details may be made therein without departing from the spirit and scope of the invention.

We claim:

1. A combined dual object device comprising, in combination:

a soft material object having an exterior configuration of a book, the book having a front surface portion including a cover and a text page releasably fastened to each other by front fastening means and a rear interior portion defined by substantially planar front and rear walls joined by a pair of side walls, and a top and a bottom wall, the text page defining the substantially planar front wall and one of the side walls defining a spine of the book to which the cover is hingedly connected;

rear fastening means located substantially in the middle of the substantially planar rear wall of said book; and another object having an interior portion and located within the rear interior portion of said book, the another object accessed by opening said rear fastening means of said book, said another object connected to said book at said rear fastening means such that said cover and said text page and said another object may be viewed substantially in full with the rear fastening means remaining open and said another object unfurled from the rear interior portion of the book, said book and said another object connected in such a manner that their interior portions are joined.

2. The device of claim 1 wherein said book has securing means located on the front surface portion thereof for securing at least one of an audiotape and a compact disk.

3. The device of claim 1 wherein the front surface portion includes at least one of words and images.

4. The device of claim 3 wherein the at least one of words and images thematically corresponds to the another object.

5. A combined dual object device comprising, in combination:

a soft material object having a first exterior configuration of a book and a second exterior configuration of an animate type object, the book having a front surface portion including a cover and a text page with at least one of words and images that thematically correspond to the animate type object and an interior portion defined by substantially planar front and rear walls joined by a pair of side walls and a top and a bottom wall, the text page defining the substantially planar front wall and one of the side walls defining a spine of the book to which the cover is hingedly connected and said animate type object having an interior portion; and rear fastening means on said substantially planar rear wall of said book and on a rear portion of said animate type object for opening to either reverse the book or the animate type object through the rear fastening means and then closing to seal the book or the animate type object in the other's interior portion to alternate the device between the book and the animate type object or for remaining open such that said book and said animate type object may be simultaneously and substantially viewed in full, the rear fastening means shared by and connecting the book and the animate type object.

6. The device of claims 1 or 5 wherein said front and rear fastening means includes hook and loop fastening members.

7. The device of claim 6 wherein one of the hook and loop fastening members are on the substantially planar front wall.

8. The device of claim 5 wherein said book has securing means located on the front surface portion thereof for securing at least one of an audiotape and a compact disk.

* * * * *